United States Patent [19]

Lindgren

[11] Patent Number: 5,031,675

[45] Date of Patent: Jul. 16, 1991

[54] SELF-RESEALABLE DISPENSING STOPPER FOR CONTAINER FOR FLOWABLE MATERIAL

[75] Inventor: Lars Lindgren, Skellefteå, Sweden

[73] Assignee: Rexinell AB, Skelleftea, Sweden

[21] Appl. No.: 381,676

[22] PCT Filed: Dec. 29, 1987

[86] PCT No.: PCT/SE87/00635

§ 371 Date: Jul. 14, 1989

§ 102(e) Date: Jul. 14, 1989

[87] PCT Pub. No.: WO88/05411

PCT Pub. Date: Jul. 28, 1988

[30] Foreign Application Priority Data

Jan. 15, 1987 [SE] Sweden ..... 8700145-9

[51] Int. Cl.[5] ..... B65B 3/04; B65D 47/32

[52] U.S. Cl. ..... 141/291; 141/98; 141/292; 141/301; 141/302; 141/321; 141/329; 141/346; 141/354; 141/363; 604/411; 604/415; 604/905; 206/219; 215/355; 220/202

[58] Field of Search ..... 640/416

[56] References Cited

U.S. PATENT DOCUMENTS

| | | | |
|---|---|---|---|
| 2,157,512 | 5/1939 | Watt | 141/319 |
| 2,788,029 | 4/1957 | Solie | 141/294 X |
| 2,851,201 | 9/1958 | Poitras et al. | 604/411 X |
| 3,105,613 | 10/1963 | Barton et al. | 604/415 |
| 4,507,113 | 3/1985 | Dunlap | 604/411 X |
| 4,573,506 | 3/1986 | Paoletti | 141/98 |

*Primary Examiner*—Ernest G. Cusick

*Attorney, Agent, or Firm*—Cushman, Darby & Cushman

[57] ABSTRACT

A device for sealing a container intended to be connected to a recipient provided with a connector for supply of its contents to the recipient in such a way that the container can be applied to and removed from the recipient without leakage and is sealed after the removal. For this purpose an elastic body is included in the device, which contains a cavity with a thin bottom, which cavity is adapted to the connector and is inclined relative to the longitudinal axis of the body, so that the interior portion of the body is displaced radially time of application of the device to the connector and opens a channel between the body and the container wall for air supply to the container. The interior portion of the cavity is smaller than the exterior portion of the connector to enable the connector to open the sealing device by widening a normally closed hole or slit located at the bottom of the cavity.

10 Claims, 3 Drawing Sheets

SELF-RESEALABLE DISPENSING STOPPER FOR CONTAINER FOR FLOWABLE MATERIAL

Self-Resealable Dispensing Stoppers For Container For Flowable Maker

BACKGROUND OF THE INVENTION

This invention relates to a device for sealing container intended to be connected to a recipient provided with connection means for the sealing device for supply of the contents of the container to the recipient, the connection means of which recipient is also arranged to open the sealing device upon application of the container. The sealing device is particularly useful for a liquid container which, when applied to a recipient, is to supply liquid to the recipient, for example an ink for an ink jet printer. However, this is only an example of several possible applications for the present device, which can be used everywhere, in principle, where it is desired to supply a more or less viscous or running material, inclusive of liquid, to a recipient via an applied container of some type without any considerable leakage arising when the container is applied or removed from the recipient.

In ink jet printers which are provided with ink via an added ink container closed by means of a slit rubber stopper, it is previously known to use a spout of about 5 mm thickness as a connection means, which upon application of the closed ink container perforates its slit rubber spout and is connected in this way to the ink of the container for supply thereof to the printer. However, this known arrangement has the embarrassing disadvantage that leakage arises at each change of ink container and especially in the cases when the container is not quite empty and further disadvantage that a removed container is not sealed in a satisfactory way.

In order that liquid might stream out of such a container, air must have access to the interior of the container, and, according to a known technique, this is achieved by means of a narrow hose which is placed in and extends through the rubber spout located in the container. The narrow hose permits leakage of liquid at application of the container to the printer, until the interior orifice of the hose comes over the liquid level within the container. When that interior orifice is not positioned on the printer, the liquid in the container is in contact with the air, which implies a certain loss of liquid through diffusion.

Another disadvantage of this known arrangement is that leakage may arise via the air hose as soon as the whole printer is tilted or laid on its side with the ink container in position, due to the fact that the interior orifice of the air hose normally being over the liquid level, is brought below the same when the printer is considerably aired. Changes in pressure and temperature may result in great leakage in this connection.

Attempts have been made to eliminate the leakage via the stopper of the liquid container by replacing the spout of the ink jet printer by a narrow cannula which is made to perforate a rubber membrane arranged in the container, and replacing the rubber stopper upon the application of the ink container to the printer in the same way as when handling injection solutions. However, these attempts have not been satisfactory but have pointed at several practical problems and some disadvantages of the same type as those described above. Moreover, the problem remains with the air supply, to make it possible for the ink to stream out of the container.

SUMMARY OF THE INVENTION

It is therefore the object of this invention to provide a seal of a container of the kind mentioned above which, has not the above-mentioned disadvantages, but is so constituted that it seals the container hermetically in the non-applied position of the container and makes possible, in its applied position, supply of the contents of the container to the recipient without leakage arising, and that it allows application of the container to the recipient and removal from the recipient without leakage, and that is seals the container hermetically after removal of the container from the recipient.

BRIEF DESCRIPTION OF THE DRAWINGS

The invention will be described in the following in greater detail with reference to the enclosed drawings, in which.

DETAILED DESCRIPTION

Figure 1:
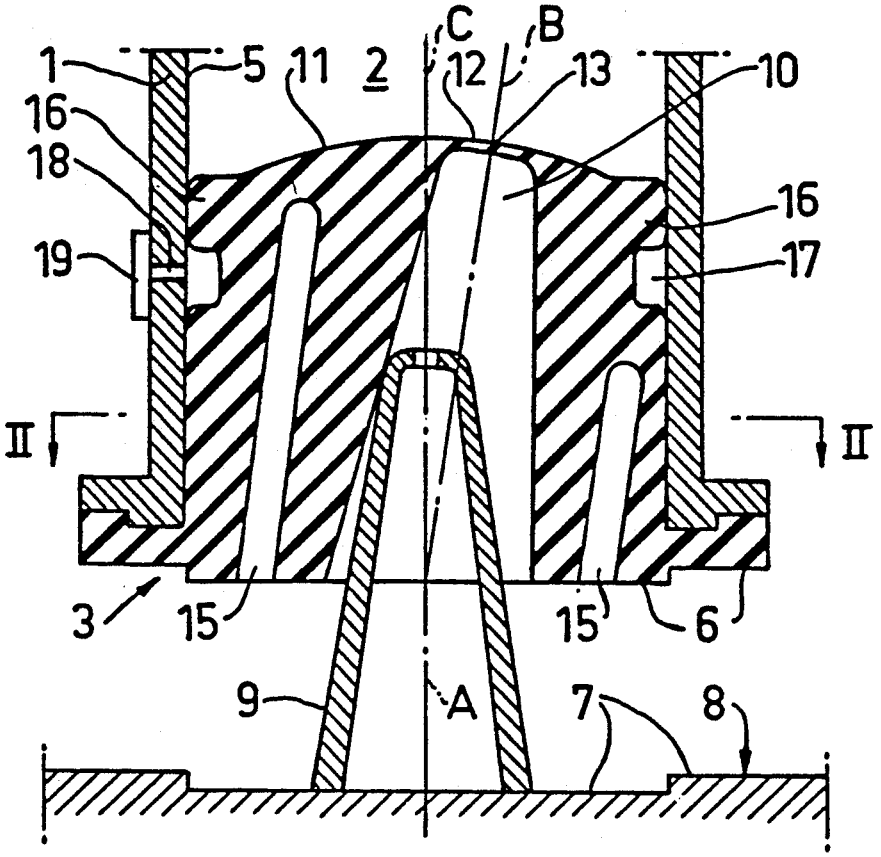
FIG. 1 shows a section of a sealing device according to the invention arranged in a sealing container in a phase during the application of the liquid container onto a connection means of a recipient.

In the drawings, there is shown an example of an embodiment of the inventive sealing device positioned in a filling and emptying opening of a liquid container, preferably formed as a throat and sealed hermetically by the sealing device in the position shown in FIG. 1. The container is designated by 1 and its opening by 2 and the sealing device by 3.

The sealing device consists of a homogeneous body or stopper 4 made of an elastic, preferably highly elastic material which is resistant to the intended liquid or material. The sealing device preferably has an external opening and should be somewhat greater than the container opening 2 with respect to its dimension, so that the stopper 4 must be pressed into position and consequently is made to fit tightly against the internal peripheral sidewall 5 of the opening.

Even if it need not always be the case, the stopper 4 according to the embodiment shown in the drawings is formed with or as a seat surface (i.e., a stop surface) 6 at its end located outside the container opening 2 for cooperation with a corresponding seat surface 7 of a recipient (8 not shown more in detail on the drawings), for fixing the container correct position on the recipient and. The connection means 9 has the form of a spout open at the end. The longitudinal axis A of the connection means forms preferably but not necessarily a right angle to the seat surfaces 7 of the recipient.

Figure 3:
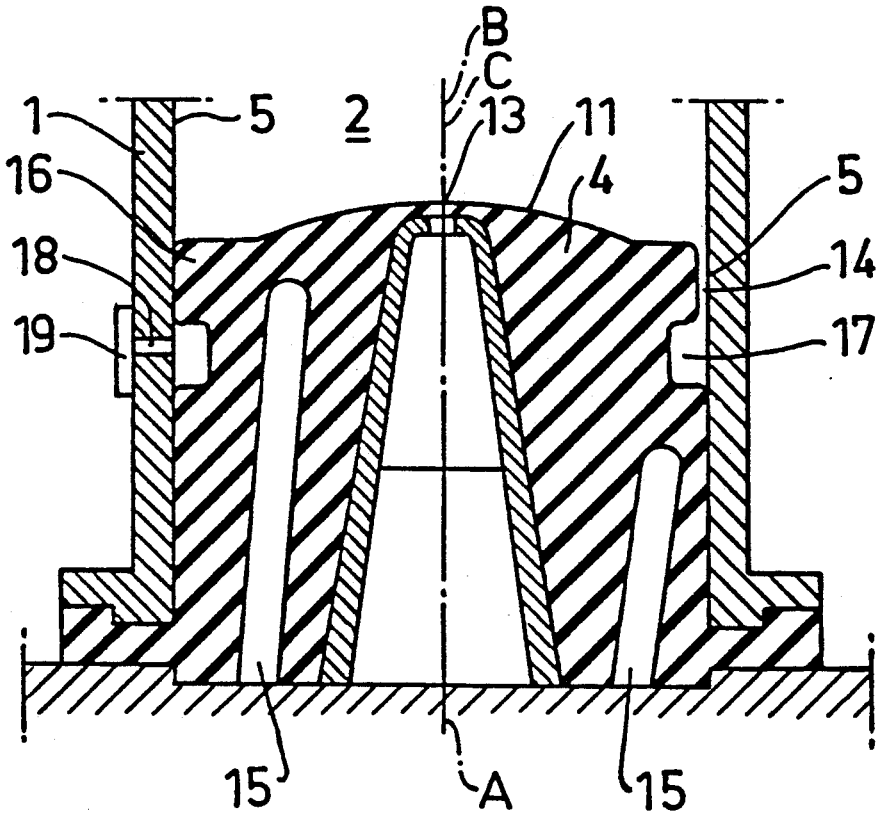
FIG. 3 shows a section of the container in FIG. 1 in a position applied to the recipient.

For cooperation with the connection means 9 of the recipient, the sealing device 3 is formed with a cavity 10 extending from the seat surface 6 and terminating at such a distance from the end surface 11 of the sealing device facing the interior of the container that a relatively thin wall or diaphragm 12 constituting the bottom of the cavity remains. A very narrow slit 13 (FIG. 3) is made in this wall 12, for example, by the aid of a thin razor blade or the like, or a very small hole is made therein, for example by the aid of a narrow sewing-needle of the like. The slit 13 or hole is located at the centre of the cavity and is kept closed by the material, due to its elastic properties and, to a certain extent, by the curved form of the cavity bottom or the wall 12. In case of a slit, it is suitable to have transversal reinforcing wires inserted in the material at the ends of the slit to prevent the slit from extending and, consequently, the material from cracking.

The cavituy 10 has a length or depth which must not be less than, and should be equal to, the length or height of the connection means 9 of the recipient, at least in the embodiment with seat surfaces shown in the drawings. In embodiments without seat surfaces, the cavity 10 of the present connection means 3 can have a depth that is less, and also substantially less, than the length of the connection means 9 of the recipient. Furthermore, the cavity 10 of the sealing device should have a form conforming or closely agreeing with the exterior form of the connection means 9 of the recipient. This agreement of form should be at least be present between the tip or exterior part of the connection means and the interior part of the cavity which, however, should be somewhat smaller in dimensional respect than the tip of the connection means. In the embodiment shown, the whole cavity, like the whole connection means 9, has the form of a more or less truncated cone but of course it can have another form suitable for the purpuse, for example, the form of a more or less truncated pyramid or wedge, or a spherical zone. At agreeement of form only between the interior part of the cavity and the tip of the connection means the remaining part of the cavity 10 and the connection, means 9 may have any other form, permitting application of the sealing device in the intended way to the connection means 9 of a recipient.

Another essential characteristics feature of the device of this invention is the orientation of the cavity in the body 4. More specifically, the cavity 10 is so located that its longitudinal axis B normally is inclined relative to the longitudinal axis C of the body 4. The angle of inclination between these is acute, the longitudinal axis B of the cavity possibly intersecting the longitudinal axis C of the body in the end surface 6 of the body, as shown on the drawings, or in spaced relationship, inwards or outward, from the end surface 6. In other words, the cross-section of the cavity in the end surface 6 need not have its centre in the longitudinal axis C of the body, but may be displaced relative to the same.

As a result of the extension and inclination of this cavity, also relative to the longitudinal axis A of the connection means, at application of a container provided with the inventive sealing device onto the connection means 9 of a recipient, the interior portion of the body is displaced radially by the connection means 9 of the recipient, and the cavity 10 is aligned and brought into a position concentric with the connection means 9. This is due to the fact that the body is compressed on one side and straightened on the other side of the connection means 9 so that it is drawn from the wall of the container opening and opens a channel 14 (FIG. 3) between the inside 5 of the container wall and the body 4. It is realized from this that the degree of inclination of the cavity must be adapted, to a large extent, to the compressibilty of the material from which the body 4 is made, and to the dimensions of the body, so that said channel 14 is always obtained.

Figure 2:
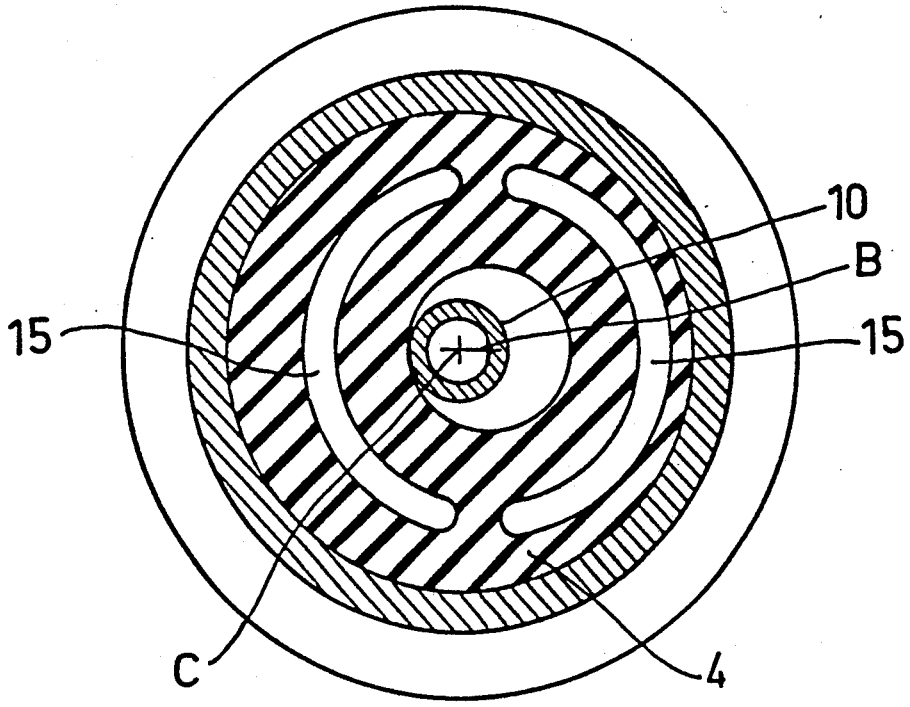
FIG. 2 shows a section taken along the line II—II in FIG. 1.

In order to make the alignment of the cavity 10 easier, the body 4 can be provided with one or more curved stops 15 located about the cavity 10, as is apparent from FIGS. 1 and 2.

At its interior peripheral section, the sealing device of the invention, further, has a sealing flange 16 running all around and a groove 17, located inside this flange 16 and also running all around, which is connected with the atmosphere through an air hole 18 arranged in the container. Thus, in this way, access of air to the interior of the container is prevented as long as the container is not applied in position on a recipient, and, in this way, loss of liquid is also avoided by diffusion during storage.

In order to prevent contamination of the liquid in the container with particles and microorganisms that may accompany incoming air, it is suitable for liquids sensitive to such a contamination to provide the air hole 18 with a hydrophobic filter 19 through which air streaming in, thus, must pass and be cleaned. In this way, such a contamination of the liquid in the container is prevented.

In the position shown in FIG. 1, the present sealing device seals the container hermetically, and at application of the container onto the connection means 9 of a recipient to be provided with liquid, the interior part of the sealing device is thus displaced radially by the connection means 9 of the recipient, the channel 14 being opened, and consequently the interior of the container is connected to the air hole 18 and the atmosphere. In its interior part, the cavity 10 is narrower than the tip of the connection means and, as a result of this, when the sealing device is pressed into position on the connection means 9, an extension of the slit 13 or the hole at the bottom of the cavity also occurs besides said radial movement. Through this opening in the wall 12 created by the connection means 9, liquid can now pass via the connections means to the recipient simultaneously as an equivalent amount of air streams into the container via the air hole 18 and the channels 17 and 14. Thus, it is avoided, in this way, that a negative pressure will be created in the container.

When the container has thereafter been removed from the recipient, the sealing device will return to its original form, meaning that the slit or hole 13 is closed and that the air passage 14 is shut as the sealing flange 16 is brought into a sealing contact with the inside 5. The container is again heremetically sealed by the sealing device, and leakage will arise in the very short time necessary for removing the container from the recipient and its connection means 9.

Figure 4:
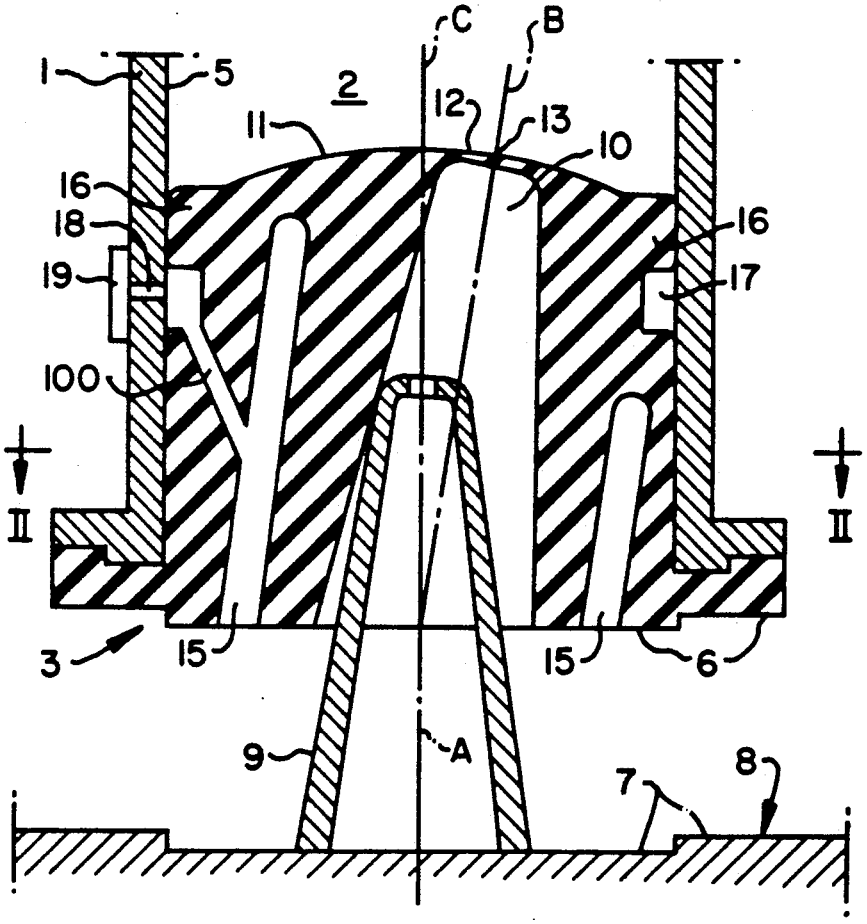
FIG. 4 is an longitudinal cross-sectional view similar to FIG. 1, of a modified embodiment wherein an air channel is provided in the body.
Figure 5:
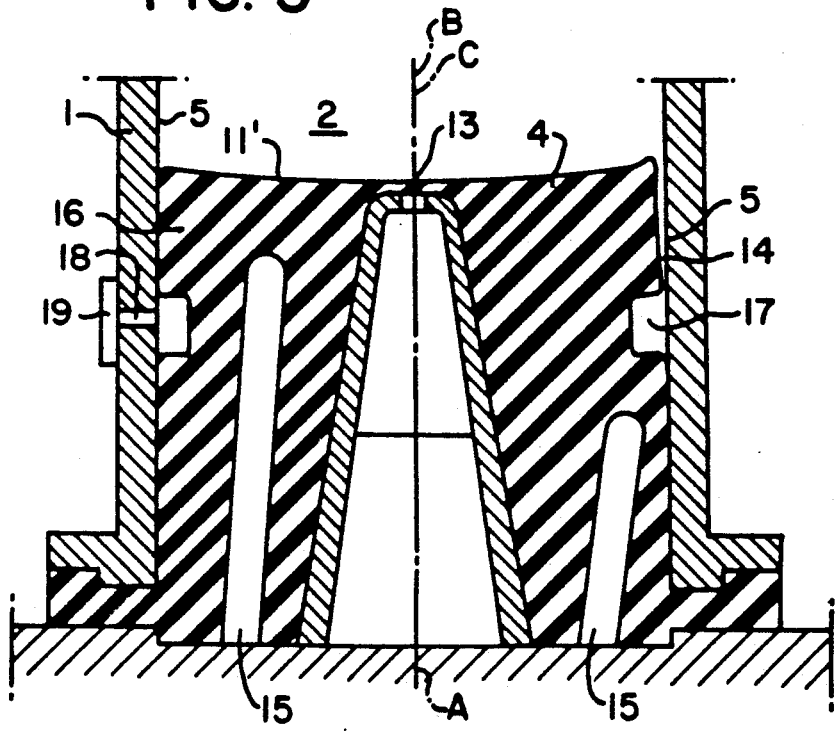
FIG. 5 is a longitudinal sectional view similar to FIG. 3, of a modified embodiment wherein the interior end surface of the body is curved concavely.

The inventions is not restricted to what has been described above and shown in the drawings, but can be amended and modified in several various ways within the scope of the invention defined in the claims. Thus, it is possible to form the interior end surface 11 of the body so that it is concavely and curved (as shown at 11' in FIG. 5), instead of convex and, furthermore, the groove or channel 17 can be connected to the atmosphere or another air source, optionally under pressure, via a channel made in the body 4, as shown at 100 in FIG. 4. The showing of the channel 100 is exemplary; neither the orientation or shape of the channel forms part of the present invention.

I claim:

1. A self-resealable dispensing stopper for a container which contains flowable material, adapted to be sealingly received against an inner peripheral wall in an opening of a container which contains flowable material, to open so as to dispense flowable material from the container into a recipient when telescopically seated on an open outer ended tubular inlet connector member of the recipient, which connector member is elongated along a longitudinal axis, and to self-sealingly close when withdrawn from seated relation to said connector member, said stopper comprising:

a body of elastic material having an outer peripheral surface arranged to circumferentially sealingly engage said inner peripheral wall in said opening in said container, so as to have, with regard to said container, an inner end wall facing towards the container and an outer end wall arranged to face towards the recipient;

means defining a longitudinally elongated cavity in said body; said cavity having an entrance opening through said outer end wall and having an end wall disposed outwardly of but adjacent said inner end wall of said body, so as to define between said end wall of said cavity and said inner end wall of said body a diaphragm of elastic material; means defining a self-resealing opening through said diaphragm, which is arranged to be opened when the diaphragm is elastically distended inwardly towards the container and to self-reseal when such distension is relaxed;

means defining a radially outwardly opening groove in said outer peripheral surface of said body at an axially intermediate location which is spaced from both said inner and outer end walls of said body, thereby providing between said groove and said inner end wall a circumferentially extending sealing surface portion of said outer peripheral surface;

said longitudinally elongated cavity being inclined so as to be centered on a cavity longitudinal axis which, when the container having the stopper mounted in the opening thereof is advanced towards the connector member along the longitudinal axis of the connector member with the entrance to the cavity centered on the longitudinal axis of the connector member, diverges from the longitudinal axis of the connector member, whereby, as connector member is telescopically received into the cavity until the outer end of the connector member sealingly engages with the end wall of the cavity perimetrically around said self-resealing opening to an open condition for communicating the flowable material in the container with the recipient through the connector member along a resulting flow path, the connector member laterally elastically distorts said body, causing the longitudinal axis of said cavity to coincide with the longitudinal axis of the connector member, and thereby elastically pulling said sealing surface portion of said outer peripheral surface of said body away from a portion of the inner peripheral wall of said opening in the container, sufficient to communicate said groove passed said sealing surface portion, so that, by also venting the groove to atmosphere, atmosphere may be communicated to the container for facilitating displacement of flowable material from the container into the recipient through said connector member.

2. The stopper of claim 1, wherein:

said groove is disposed closer to said inner end wall of said body than to said outer end wall of said body.

3. The stopper of claim 2, further including:

means defining an opening through said body from externally thereof, to said groove, for communicating atmosphere with said groove.

4. The stopper of claim 1, wherein:

said inner end wall of said body is convexly curved.

5. The stopper of claim 1, further including:

at least one further cavity, arcuate in transverse cross-section, formed in said body through said outer end wall so as to be radially spaced from both said longitudinally elongated cavity and said outer peripheral surface of said body, said at least one further cavity being disposed for facilitating elastic distortion of said longitudinally elongated cavity is telescoped onto said connector member.

6. The stopper of claim 1, further including:

stop surface means formed on said outer end wall of said body and arranged to engage with the recipient for limiting advance of the stopper along said longitudinal axis of said connector member.

7. A self-resealably stoppered container for dispensing a flowable material contained in the container, comprising:

a container for a flowable material, said container having an opening having an inner peripheral wall; and a self-resealable dispensing stopper sealingly received against said inner peripheral wall in said opening of said container, to open so as to dispense flowable material from the container into a recipient when the telescopically seated on an open outer ended tubular inlet connector member of the recipient, which connector member is elongated along a longitudinal axis, and to self-sealingly close when withdrawn from seated relation to said connector member, said stopper comprising:

a body of elastic material having an outer peripheral surface arranged to circumferentially sealingly enagage said inner peripheral wall in said opening in said container, so as to have, with regard to said container, an inner end wall facing towards the container and an outer end wall arranged to face towards the recipient;

means defining a longitudinal elongated cavity in said body; said cavity having an entrance opening through said outer end wall and having an end wall disposed outwardly of but adjacent said inner end wall of said body, so as to define between said end wall of said cavity and said inner end wall of said body a diaphragm of elastic material; means defining a self-resealing opening through said diaphragm, which is arranged to be opened when the diagragm is elastically distended inwardly towards the container and to self-reseal when such distension is relaxed;

means defined a radially outwardly opening groove in said outer peripheral surface of said body at an axially intermediate location which is spaced from both said inner and outer end walls of the body, thereby providing between said groove and said inner end wall a circumferentially extending sealing surface portion of said outer peripheral surface;

said longitudinally elongated cavity being so as to be centered on a cavity longitudinal axis which, when the container having the stopper mounted in the opening thereof is advanced towards the connector member along the longitudinal axis of the connector member with the entrance to the cavity centered on the longitudinal axis of the connector member, diverges from the longitudinal axis of the connector member, wherein, as connector member is telescopically received into the cavity until the outer end of the connector member sealingly engages with the end wall of the cavity perimetrically around said self-resealingly opening and elastically distends said self-resealing opening to an open condition for communicating the flowable material in the container with the recipient through the connector member along a resulting flow path, the connector member laterally elastically distorts said body, causing the longitudinaly axis of said cavity to coincide with the longitudinal axis of the connector member, and thereby elastically pulling said sealing surface portion of said outer peripheral surface of said body away from a portion of said opening in the container, sufficient to communicate said groove passed said sealing surface portion, so that, by also venting the groove to atmosphere, atmosphere may be communicated to the container for facilitating displacement of flowable material from the container into the recipient through said connector member.

8. The self-sealingly stoppered container of claim 7, wherein:

said groove extends completely circumferentially around said body.

9. The self-sealingly stoppered container of claim 8, further including:

said opening in said container being provided through a neck provided on said container;

means defining an opening through said neck communicating atmosphere externally of said container with said groove.

10. The self-sealingly stoppered container of claim 9, further including:

a hydrophobic filter member arranged across said opening through said neck, for filtering atmospheric communication with flowable material in said container.

* * * * *